United States Patent [19]

Woods

[11] 4,352,284

[45] Oct. 5, 1982

[54] VERTICAL PRESS

[75] Inventor: Thomas W. Woods, Toronto, Australia

[73] Assignee: T. W. Woods Constructions Pty. Limited, Australia

[21] Appl. No.: 154,084

[22] Filed: May 28, 1980

[51] Int. Cl.[3] ..... B21J 9/18

[52] U.S. Cl. ..... 72/452; 72/453.03

[58] Field of Search ..... 72/452, 453.03, 455, 72/172, 174; 100/214, 271, 291, 231

[56] References Cited

U.S. PATENT DOCUMENTS

| | | | |
|---|---|---|---|
| 509,265 | 11/1893 | Tweddell | 72/452 |
| 936,481 | 10/1909 | Scheld | 72/174 |
| 1,422,779 | 7/1922 | Perony | 72/453.03 |
| 2,095,331 | 10/1937 | Huck | 72/174 |
| 2,685,322 | 8/1954 | Gerster | 72/172 |
| 3,743,469 | 7/1973 | Gibbons | 100/271 |
| 3,939,686 | 2/1976 | Walters | 72/452 |
| 4,008,659 | 2/1977 | Trolle | 100/214 |

*Primary Examiner*—Gene Crosby

*Attorney, Agent, or Firm*—D. Paul Weaver

[57] ABSTRACT

A vertical press having a main frame of generally C-shaped configuration with a vertical main part and two vertically spaced horizontal arms, a mandrel extending between the two arms so as to be supported thereby, a movable member located between the main part and the mandrel, and a wedge arrangement to move the movable member toward the mandrel in a pressing action.

2 Claims, 4 Drawing Figures

VERTICAL PRESS

The present invention relates to presses and more particularly but not exclusively to vertical presses to deform metal sheet.

These are illustrated in U.S. Pat. Nos. 509,265; 936,481; 2,095,331; 1,422,779 and 2,685,322. These presses are unduly complex and do not lend themselves to the easy manufacture of curved metal sheet.

It is an object of the present invention to overcome or substantially ameliorate the above disadvantages.

There is disclosed herein a vertical press comprising a frame of generally C-shaped configuration, having a vertically extending main part and two vertically spaced generally horizontally extending arms; a vertical mandrel supported by and extending between the two arms and spaced from said main part; a movable member extending between said arms and located between said main part and said mandrel, said member being movably supported by said arms so as to be horizontally movable toward said mandrel, and means to move said member in a pressing action toward said mandrel, said means including at least two opposing reaction surfaces, one fixed to said main part, and one to said movable member, and a movable wedge located between said surfaces and adapted to operatively engage same to cause movement thereof upon movement of said wedge to thereby cause said movable member to move toward said mandrel in a pressing action.

A preferred form of the present invention will now be described by way of example with reference to the accompanying drawings, wherein.

Figure 1:
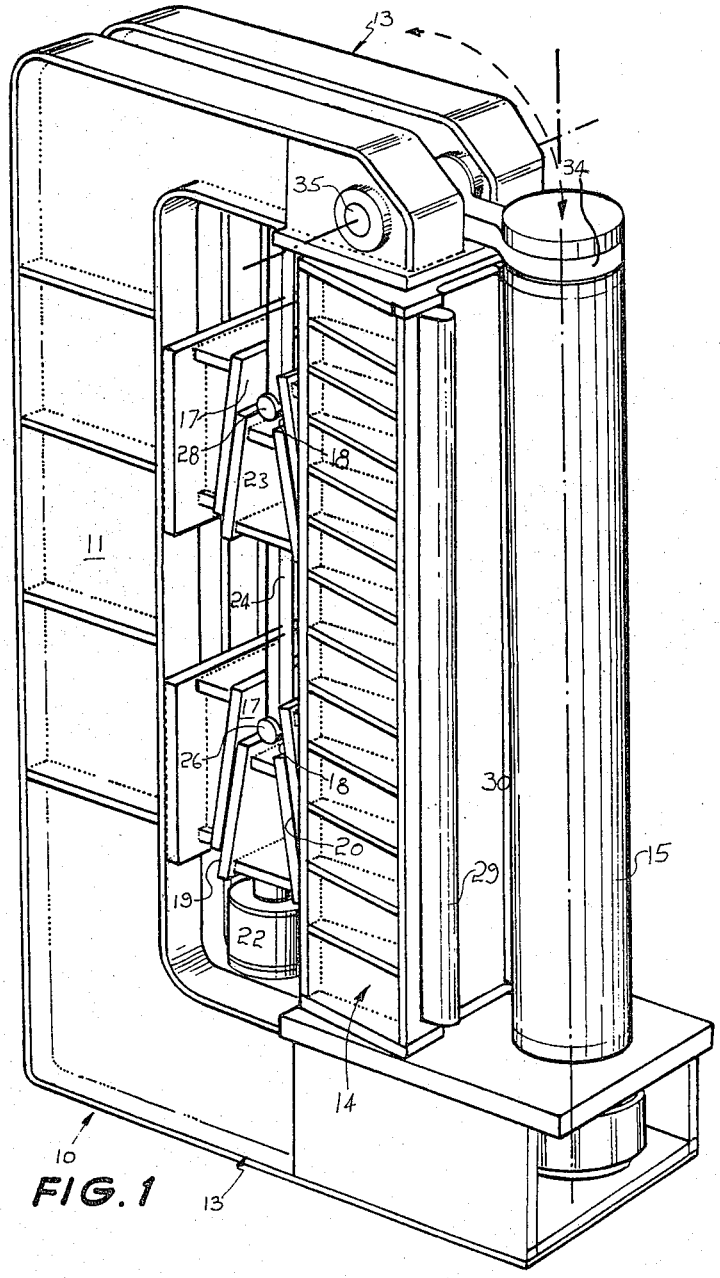
FIG. 1 is a schematic perspective view of a vertical press.

The press depicted includes a main frame 10 of generally C-shaped configuration having a main portion 11 which extends generally vertically and two transverse arms 12 and 13, which extend outwardly from the main portion 11. The arms 12 and 13 provide supports for a movable member 14 which is slidably guided by the transverse arms 12 and 13. Fixed to the extremities of the arms 12 and 13 is a stationary mandrel 15 rotatably supported by the arms 12 and 13 so as to be rotatable about its longitudinal axis by means of a pump and hydraulic motor of which the motor is designated by the numeral 16. Located between the main frame portion 11 and the movable member 14 is an arrangement to move the movable member 14 toward the mandrel 15. This arrangement includes opposing cam faces 17 and 18 which are slidably engaged by faces 19 and 20 of wedges 21 and 23. The wedge 21 is driven upwardly by hydraulic rams 22 while the wedge 23 is moved upwardly by connecting member 24, which extends between the wedges 21 and 23. The hydraulic rams 22 are connected to the wedge 21 by means of a pivotable joint 25 while the member 24 abuts the wedges 21 and 23 by pivotable joints 26. To retract the movable member 14 there is provided hydraulic rams 27 which abut the wedge 23 also by a pivotable joint 28.

Figure 3:
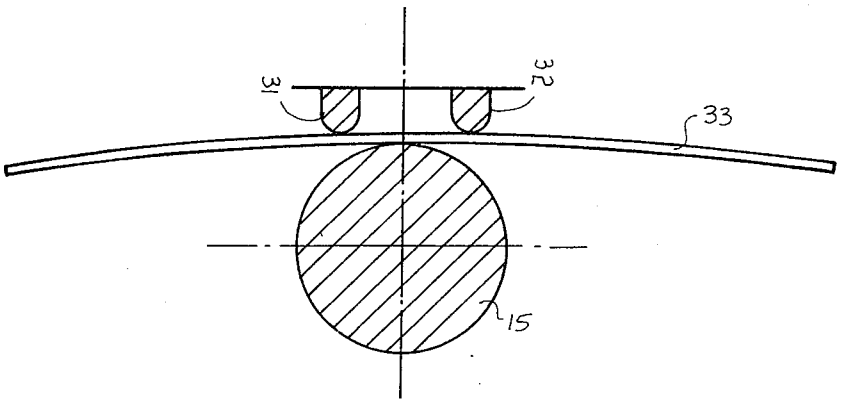
FIG. 3 is a schematic plan view of a sheet being deformed in the press of FIG. 1.

Attached to the leading face of the movable member 14 is a former 29 which is adapted to engage a sheet of metal located in the space 30 defined between the former 29 and mandrel 15. The former 29 in combination with the mandrel 15 determines the shape into which the metal sheet will be deformed. For example, if the mandrel 15 is of constant circular cross-section and the former of uniform cross-section then the metal will be deformed so as to form a cylinder. This can be best seen from FIG. 3 wherein the mandrel 15 is depicted of a circular cross-section and the former 29 of U-shaped cross-section having leading lugs 31 and 32 depress the metal sheet 33 against the mandrel 15. There could be additionally provided means to retain the sheet 33 against the mandrel 15 when the former 29 is retracted as the mandrel 15 is rotated to locate a further portion of the sheet 33 in a position to be deformed. The member 27 is retracted by a ram not depicted. This not depicted ram is coupled to the hydraulic circuit by an accumulator.

Preferably, the press is provided with a hydraulic control means which incrementally rotates the mandrel 15 in synchronism with the reciprocating motion of the movable member 14. It should be appreciated that the hydraulic controls could be replaced with electronic controls.

It should further be appreciated that the shape of the mandrel 15 and former 29 may be altered to form objects of different shapes rather than a cylinder, for example conical shapes, and angled shapes such as squares and rectangles.

Figure 2A:
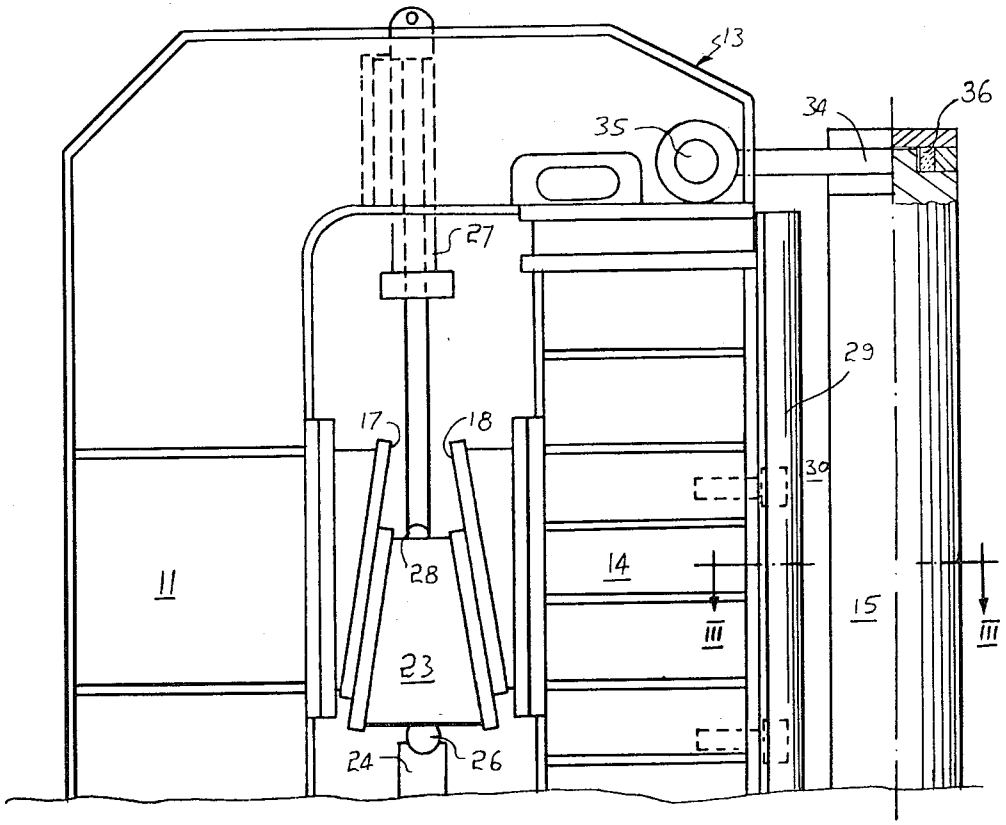
FIG. 2A is a schematic side elevation of the top portion of the press of FIG. 1.
Figure 2B:
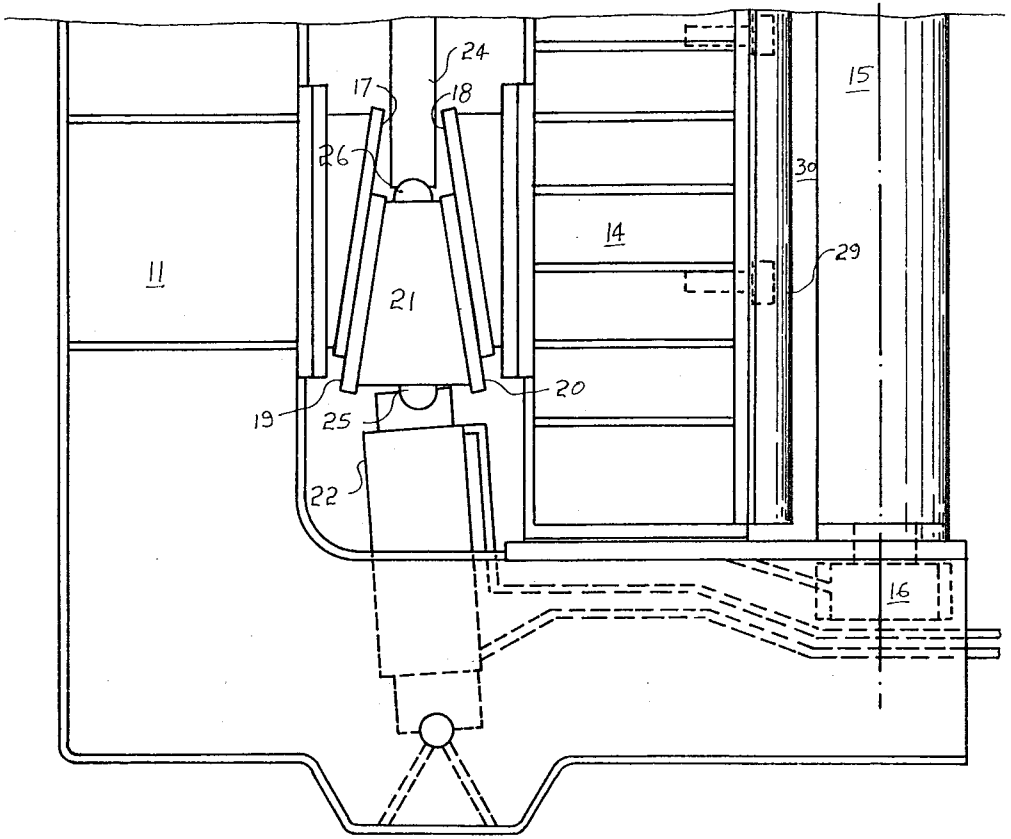
FIG. 2B is a schematic side elevation of the bottom portion of the press of FIG. 1.

The above described embodiment may be altered to eliminate the need for rams 27 by having rams 22 double acting. To aid in the replacement of the mandrel 15 the support 34 is pivotally attached to arm 13 by means of pin 35. The support 34, FIG. 2A, is connected to the rotatable mandrel 15 through a suitable bushing 36, as shown.

What I claim is:

1. A vertical press comprising a frame of generally C-shaped configuration having a vertically extending main part and two vertically spaced generally horizontally extending arms, a vertical mandrel extending between said arms in spaced parallel relationship to said main part and being connected to said arms, a movable member parallel to said mandrel extending between said arms and located between said main part and mandrel, said member being movably engaged with said arms so as to be horizontally movable toward said mandrel, power means to move the movable member in a pressing action toward said mandrel, said power means including two pairs of vertically spaced opposing reaction inclined converging surfaces, one of each pair of surfaces being fixed to said main part and the other surface of each pair being fixed to the movable member, the two pairs of surfaces converging in the same direction toward one of said arms of said frame, a movable wedge disposed between each pair of said surfaces and engaging said surfaces slidably to cause displacement of the surfaces fixed to the movable member responsive to simultaneous movement of the wedges in one direction along the axis of taper of the wedges and toward one of said arms, the surfaces of the pairs and opposing coacting surfaces of the wedges arranged to define predetermined equal acute angles and all such surfaces being inclined to the vertical, said power means including cylinder means connected between one of said arms and said wedges to move the wedges in unison along their common axis of taper without relative movement, and rigid means between spaced end faces of the wedges assuring their movement in unison under influence of said cylinder means.

2. A vertical press as defined in claim 1, and spaced metal forming elements on said movable member at its side opposing said mandrel.

* * * * *